US011769393B1

(12) United States Patent
Lontka et al.

(10) Patent No.: US 11,769,393 B1
(45) Date of Patent: Sep. 26, 2023

(54) FIRE SAFETY DEVICE ADDRESS AND LOCATION VERIFICATION

(71) Applicant: Siemens Industry, Inc., Alpharetta, GA (US)

(72) Inventors: Karen Lontka, Randolph, NJ (US); Paul Richard Strelecki, Whitehouse Station, NJ (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 17/820,357

(22) Filed: Aug. 17, 2022

(51) Int. Cl.

| | |
|---|---|
| ***G08B 25/14*** | (2006.01) |
| ***G08B 25/00*** | (2006.01) |
| ***G08B 25/10*** | (2006.01) |
| ***G08B 29/18*** | (2006.01) |

(52) U.S. Cl.
CPC ..... *G08B 25/14* (2013.01); *G08B 25/003* (2013.01); *G08B 25/10* (2013.01); *G08B 29/18* (2013.01)

(58) Field of Classification Search
CPC ..... G08B 25/14; G08B 25/003; G08B 25/10; G08B 29/18
See application file for complete search history.

(56) References Cited

U.S. PATENT DOCUMENTS

| | | | | |
|---|---|---|---|---|
| 6,570,496 | B2 | 5/2003 | Britton | |
| 7,072,675 | B1 * | 7/2006 | Kanakubo | H04M 1/72412 455/425 |
| 7,106,187 | B2 | 9/2006 | Penney et al. | |
| 7,239,236 | B1 | 7/2007 | Britton et al. | |
| 8,008,799 | B2 * | 8/2011 | Rofougaran | H01Q 23/00 307/3 |
| 8,760,280 | B2 | 6/2014 | Piccolo | |
| 10,038,501 | B2 | 7/2018 | Castor et al. | |
| 10,833,765 | B2 | 11/2020 | Linnartz et al. | |
| 2019/0215654 | A1 | 7/2019 | Engelen et al. | |

FOREIGN PATENT DOCUMENTS

| | | | | |
|---|---|---|---|---|
| CA | 1116284 A | | 1/1982 | |
| KR | 1020090017148 A | * | 2/2009 | B60C 23/00 |
| WO | 2007009937 A1 | | 1/2007 | |

* cited by examiner

*Primary Examiner* — John A Tweel, Jr.

(57) ABSTRACT

A system includes a plurality of remote addressable devices, each remote addressable device of the plurality of remote addressable devices being individually programmed with configuration data of the respective addressable device. Each remote addressable device includes a radio frequency (RF) transceiver to transmit a RF signal encoded with an address and a physical location of the remote addressable device transmitting the RF signal. The system further includes a plurality of bases. Each base of the plurality of bases includes a RF sensor for receiving the RF signal from the RF transceiver of the corresponding remote addressable device subsequent to the remote addressable device being positioned in the base.

20 Claims, 9 Drawing Sheets

FIRE SAFETY DEVICE ADDRESS AND LOCATION VERIFICATION

BACKGROUND

1. Field

Aspects of the present invention generally relate to fire safety networks of addressable devices for commercial and residential buildings and, more particularly, to systems and methods for verification of an addressable device's location upon installation or re-installation.

2. Description of the Related Art

In a fire and/or security system having a central controller (such as a fire panel) and remote addressable devices (such as fire detectors, smoke detectors, and alarm notification appliances) it is necessary to verify that each addressable device is installed in the correct physical location within a structure and is properly configured and operational. However, it is possible that such remote addressable devices that is configured for one physical location (e.g., room 2 floor 1 or zone 1) may be unintentionally installed in a different "wrong" location in the building (e.g., room 10 floor 2 or zone 2). This problem is euphemistically referred to as the "painter problem" where a painter removes all the remote addressable devices from their respective bases, paints the rooms and halls, and then replaces the remote addressable devices in the wrong bases.

By individually activating each remote addressable device its installed location and proper operation can be verified at a central controller such as a fire panel. This verification can be accomplished by two service technicians, one that manually activates the remote addressable device and the other at the central controller or fire panel. Typically, these two technicians will communicate verbally to verify the proper operation and association of an addressable device to the physical location stored in the database of the central controller or fire panel. Alternately, a single technician can perform verification by manually activating a single addressable device and then physical going to the central controller or fire panel location to verify that the correct operation and location was observed for the activated device. Both of these manual device location verification approaches takes significant time and costs for a qualified technician to complete.

SUMMARY

Briefly described, aspects of the present invention relate to a verification system and a method for verifying a remote addressable device's installation location, device specific configuration data and operational status. Presented here are systems and methods to non-ambiguously assure that a respective device is in the correct location (for communication with the proper fire panel or other system controller) without requiring another worker at the fire panel to verify address and location of a particular device and when wireless (cloud) connectivity is not available or prohibited.

In accordance with one illustrative embodiment of the present invention, a system comprises a plurality of remote addressable devices. Each remote addressable device of the plurality of remote addressable devices being individually programmed with configuration data of the respective addressable device. Each remote addressable device includes a radio frequency (RF) transceiver to transmit a RF signal encoded with an address and a physical location of the remote addressable device transmitting the RF signal. The system further comprises a plurality of bases. Each base of the plurality of bases includes a RF sensor for receiving the RF signal from the RF transceiver of the corresponding remote addressable device subsequent to the remote addressable device being positioned in the base.

In accordance with one illustrative embodiment of the present invention, a method comprises programming configuration data of a plurality of remote addressable devices, each remote addressable device of the plurality of remote addressable devices being individually programmed with the configuration data of the respective addressable device. The method further comprises positioning each remote addressable device of the plurality of remote addressable devices in a corresponding base of a plurality of bases. The method further comprises transmitting a RF signal from a radio frequency (RF) transceiver of each remote addressable device, each RF signal being encoded with an address and a physical location of the remote addressable device transmitting the RF signal. The method further comprises receiving the RF signal from the RF transceiver of each remote addressable device by an RF sensor of the corresponding base subsequent to the remote addressable device being positioned in the base.

In accordance with one illustrative embodiment of the present invention, a system comprises a plurality of remote addressable devices including a first remote addressable device. Each remote addressable device of the plurality of remote addressable devices being individually programmed with configuration data of a respective addressable device of the plurality of remote addressable devices. Each remote addressable device includes a radio frequency (RF) microelectromechanical systems (MEMS) chip with a RF transceiver to produce a RF signal. The system further comprises a plurality of bases including a first base. Each base of the plurality of bases includes a RF MEMS chip with a RF sensor adapted to sense a first RF signal from a first RF MEMS chip with a first RF transceiver affixed to the first remote addressable device such that when the first remote addressable device is inserted or installed in the first base a first RF MEMS chip with a first RF sensor on the first base receives the first RF signal from the first RF MEMS chip with the first RF transceiver. The received first RF signal is encoded with an address and a physical location of the first remote addressable device such that the first RF MEMS chip on the first base learns configuration including the address and the physical location of a first new remote addressable device installed in the first base.

The above described features and advantages, as well as others, will become more readily apparent to those of ordinary skill in the art by reference to the following detailed description and accompanying drawings. While it would be desirable to provide one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects.

DETAILED DESCRIPTION

Figure 1:
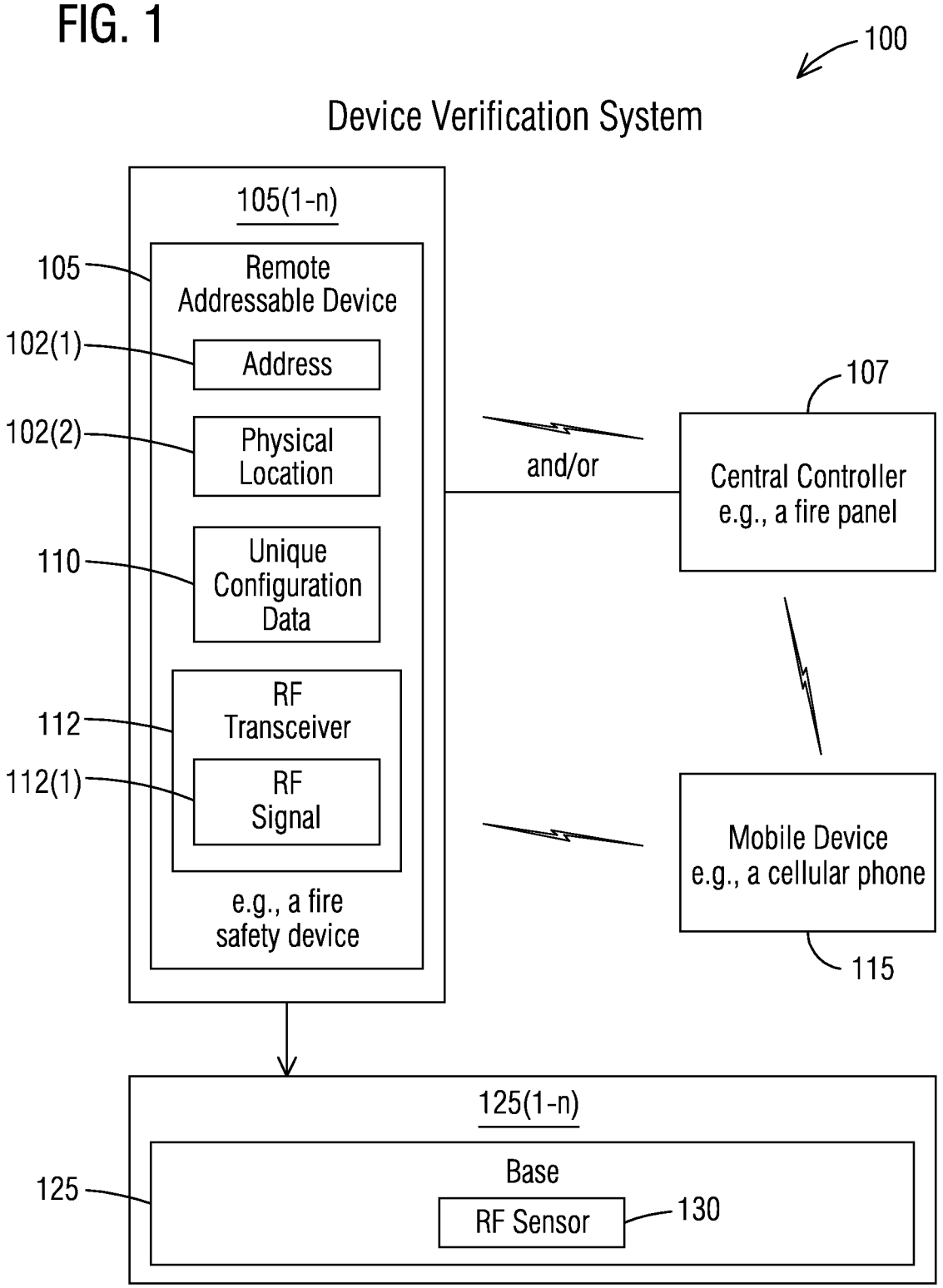
FIG. 1 illustrates a device verification system configured to verify an address and a physical location of a remote addressable device such as a fire safety device communicating with a central controller such as a fire panel in accordance with an example embodiment of the present invention.

Various technologies that pertain to systems and methods that facilitate a device verification mechanism to verify a remote addressable device will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to example non-limiting embodiments.

To facilitate an understanding of embodiments, principles, and features of the present invention, they are explained hereinafter with reference to implementation in illustrative embodiments. In particular, they are described in the context of device verification mechanism for verifying a remote addressable device. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of the device verification mechanism according to the present disclosure are described below with reference to FIGS. 1-11 herein. Like reference numerals used in the drawings identify similar or identical elements throughout the several views. The drawings are not necessarily drawn to scale.

Regulations governing fire systems require a visual inspection of all fire and smoke detectors and alarm notification appliances in a building system. When these devices are network addressable by a fire panel or other system controller, there exists the possibility that the unit will be connected to the network of the system but placed in the wrong physical location in the building. This is euphemistically referred to as the "painter problem" where a painter removes all the devices from their respective bases, paints the rooms and halls, and then replaces the devices in the wrong bases. Outlined here are methods to non-ambiguously assure that a respective device is in the correct location (for communication with the proper fire panel or other system controller) without requiring another worker at the fire panel to verify address and location of a particular device and when wireless (cloud) connectivity is not available or prohibited.

Each solution embodiments of this invention allows for verification of a remote addressable device's installation location, device specific configuration data and operational status. Another benefit is that certain of these solutions may need only one technician or self-report to a fire panel without the need for a technician. In the case of a single technician, the solutions eliminate traveling between the addressable device and the location of the central controller or fire panel. The solutions also result in reduced device validation time and associated labor costs.

Consistent with one embodiment of the present invention, FIG. 1 represents a device verification system 100 in accordance with an example embodiment of the present invention. The device verification system 100 is configured to verify an address 102(1) and a physical location 102(2) of a remote addressable device 105 such as a fire safety device communicating with a central controller 107 such as a fire panel in accordance with an example embodiment of the present invention. For device identification, address plates are installed on all addressable components, indicating the address 102(1) of the remote addressable device 105. Labels are clearly readable when the device 105 is mounted at a ceiling and the reader is standing at least 2 or 3 feet away from the device 105. For example, labels are to be of a permanent type, 24 point height, black letter on white tape, with clear laminate overlay. To address the remote addressable device 105 such as a fire alarm device, for a fire alarm system, the numbers on the switches on the detectors and modules represent a number used in identification (addressing). Examples of the physical location 102(2) include (e.g., room 2 floor 1 or zone 1) in the building or (e.g., room 10 floor 2 or zone 2).

The device verification system 100 may be an addressable fire alarm system. An addressable fire alarm system is one in which all fire and smoke detection devices in a system are connected and communicate both with each other and a central control monitoring location. This interconnectivity allows the control personnel to identify the location or "address" where the initial detection occurred. An addressable system sends digital signals in binary code, as opposed to a conventional fire alarm system which operates through electrical currents. Addressable devices do not require a loop. They use communication techniques that allow multiple devices on a given pair of wires to communicate with a central location via some, typically proprietary, communication protocol. In addressable systems, a device can be removed or disabled and it will not affect the other devices in the loop.

For example, an addressable fire alarm system is one in which all fire and smoke detection devices in a system are connected and communicate both with each other and a central control monitoring location. This interconnectivity allows the control personnel to identify the location or "address" where the initial detection occurred. The information directs the emergency response team to pinpoint their efforts immediately to the precise location of the developing problem. Each detection and notification device is connected to each other. Moreover, each device is connected directly to the central addressable fire alarm control panel which is continually sending messages to check on the functionality of each instrument. In response, each element sends back a report that informs the control panel of its current health. If for any reason a device does not respond, the control panel indicates a problem at that particular address. Authorized technicians from the fire alarm maintenance company can immediately proceed to the location, fix or replace the problem device, and the issue is solved. An additional advantage of an addressable fire alarm system is that elements can be programmed to respond in particular ways with specific responses. Systems can be programmed to create a "cause and effect" response. In large buildings with several stories, wings or sections, it is possible to program alarms that are some distance away from the activated alarm to delay sounding to evacuate the building in orderly sequences. Addressable devices do not require a loop. They use communication techniques that allow multiple devices on a given pair of wires to communicate with a central location via some, typically proprietary, communication protocol. Addressable fire alarm systems allow for routine monitoring of the health of each connected device. Alarms will transmit a signal to indicate weakness or malfunction of any component. The source of the problem is identifiable by address and can be serviced easily. The ability to self-diagnose and repair ensures the system will properly function when needed. With independently wired alarms, each device must be checked separately to ensure functionality, and neglect can result in disaster.

The device verification system 100 comprises a plurality of remote addressable devices 105(1-*n*). Each remote addressable device of the plurality of remote addressable devices 105(1-*n*) being individually programmed with configuration data 110 of a respective addressable device. Each remote addressable device including a radio frequency (RF) transceiver 112 to transmit a RF signal 112(1) encoded with an address 102(1) and a physical location 102(2) of the remote addressable device 105 transmitting the RF signal 112(1).

The device verification system 100 further comprises a plurality of bases 125(1-*n*). Each base 125 of the plurality of bases 125(1-*n*) including a RF sensor 130 receiving the RF signal 112(1) from the RF transceiver 112 of the corresponding remote addressable device 105 subsequent to the remote addressable device 105 being positioned in the base 125.

The device verification system 100 further comprises a mobile device 115 (e.g., any type of portable communication device such as a cellular phone, smartphone, tablet, laptop, and the like) communicating with the plurality of remote addressable devices 105(1-*n*). The mobile device 115 receives the RF signal 112(1) from the respective addressable device 105 of the plurality of remote addressable devices 105(1-*n*) and demodulate the RF signal 112(1) to extract the unique configuration data 110 associated with the respective addressable device 105 of the plurality of remote addressable devices 105(1-*n*).

The device verification system 100 further comprises a central controller 107 communicating with the plurality of remote addressable devices 105(1-*n*) and the mobile device 115. The mobile device 115 or the central controller 107 identifies the physical location 102(2) for each remote addressable device of the plurality of remote addressable devices 105(1-*n*). The mobile device 115 or the central controller 107 further determines that the respective remote addressable device 105 is properly configured and operational for communication with the central controller 107 in response to identifying verification that the respective remote addressable device 105 is installed in the physical location 102(2) associated with the respective remote addressable device 105 within a structure.

The device verification system 100 without requiring another worker at the central controller 107 verifies an address and a physical location of a particular remote addressable device of the plurality of remote addressable devices 105(1-*n*).

Figure 2:
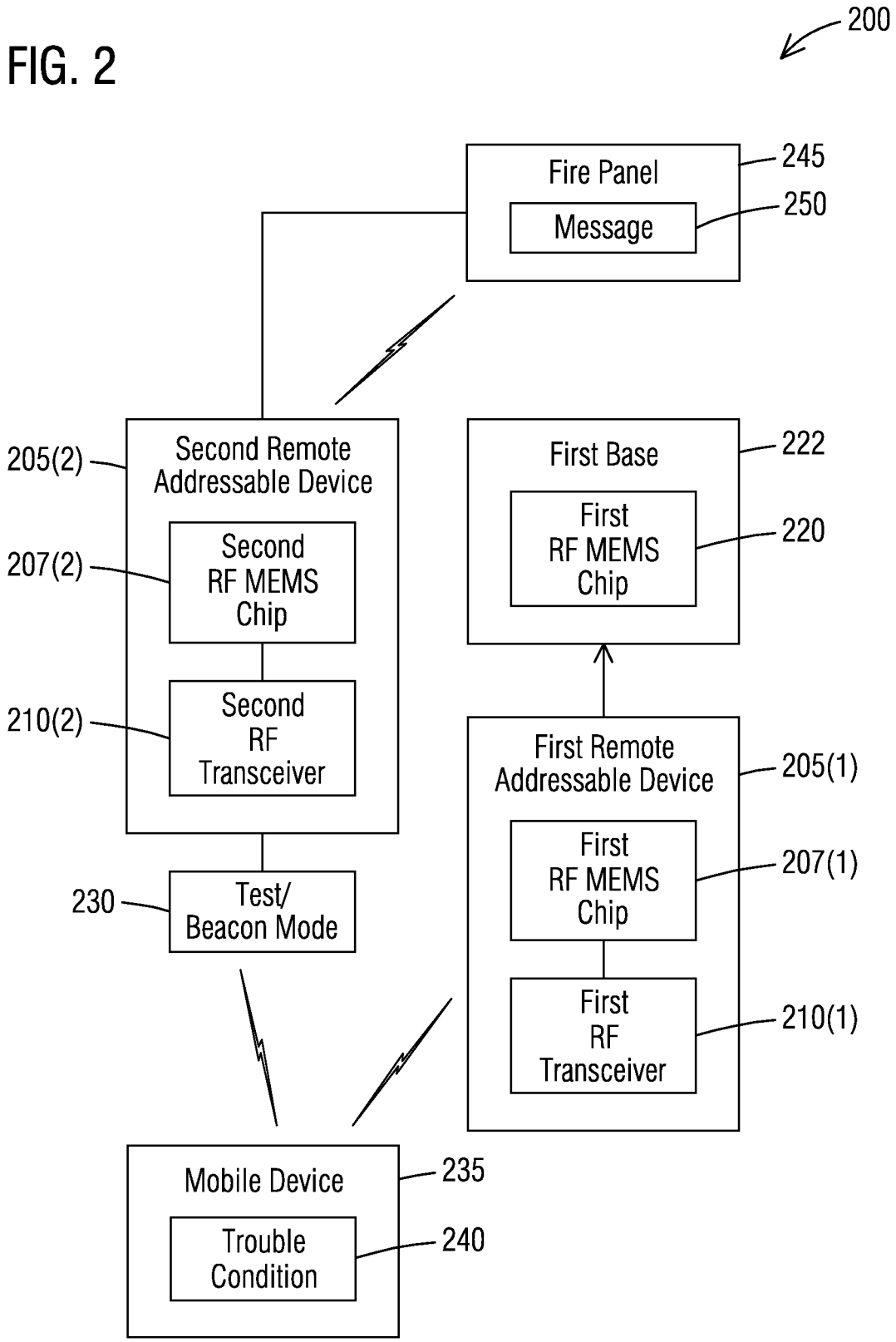
FIG. 2 illustrates a device verification system comprising a first remote addressable device that includes a first RF MEMS chip with a first RF transceiver and a second remote addressable device that includes a second RF MEMS chip with a second RF transceiver in accordance with an example embodiment of the present invention.

Referring to FIG. 2, it illustrates a device verification system 200 comprising a first remote addressable device 205(1) that includes a first RF MEMS chip 207(1) with a first RF transceiver 210(1) and a second remote addressable device 205(2) that includes a second RF MEMS chip 207(2) with a second RF transceiver 210(2) in accordance with an example embodiment of the present invention. A RF signal encoded with an address and a physical location of the first remote addressable device 205(1) is received such that a first RF MEMS chip 220 on a first base 222 of a plurality of bases learns configuration including the address and the physical location of a new, i.e., the first remote addressable device 205(1) installed in the first base 222.

If a remote addressable device in the first base 222 is removed and the second remote addressable device 205(2) different from the remote addressable device is inserted into the first base 222 that was previously paired with the remote addressable device the second RF MEMS chip 207(2) on the second remote addressable device 205(2) recognizes that the first base 222 is already configured to another device and goes into a test/beacon mode 230 to signal to a mobile device 235 a trouble condition 240. The second remote addressable device 205(2) is configured to report the trouble condition 240 to a fire panel 245 with a message 250 that indicates an identity of the second remote addressable device 205(2) (i.e., its address and original base location) and that it is now installed in a wrong base. A base of the plurality of bases may be pre-programmed based on a RF MEMS chip which has an address and a physical location associated with an installed base.

Figure 3:
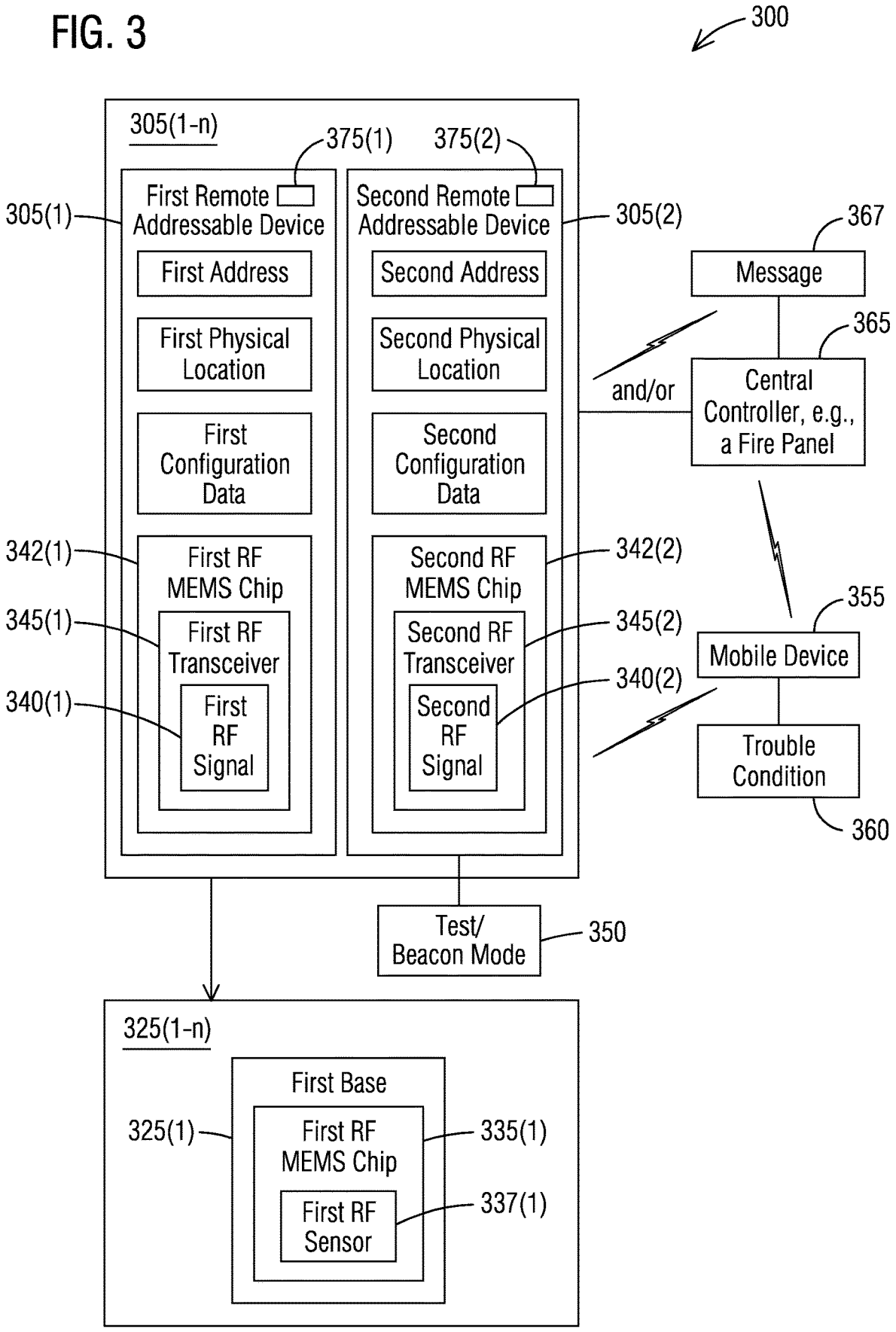
FIG. 3 illustrates a device verification system comprising a plurality of remote addressable devices wherein each remote addressable device includes a radio frequency (RF) micro-electromechanical systems (MEMS) chip with a RF transceiver to produce a RF signal and a plurality of bases wherein each base of the plurality of bases includes a RF MEMS chip with a RF sensor adapted to sense a first RF signal from a first RF MEMS chip with a first RF transceiver in accordance with an example embodiment of the present invention.

Turning now to FIG. 3, it illustrates a device verification system 300 comprising a plurality of remote addressable devices **305(1-*n*). Each remote addressable device includes a radio frequency (RF) micro-electromechanical systems (MEMS) chip with a RF transceiver to produce a RF signal. The device verification system 300 further comprises a plurality of bases 325(1-*n*)**. Each base includes a RF MEMS chip with a RF sensor adapted to sense a RF signal from a RF MEMS chip with a RF transceiver in accordance with an example embodiment of the present invention.

The plurality of remote addressable devices **305(1-*n*) includes a first remote addressable device 305(1). Each remote addressable device of the plurality of remote addressable devices 305(1-*n*) being individually programmed with configuration data of a respective addressable device of the plurality of remote addressable devices 305 (1-*n*)**. Each remote addressable device includes a radio frequency (RF) micro-electromechanical systems (MEMS) chip with a RF transceiver to produce a RF signal.

The plurality of bases **325(1-*n*) include a first base 325(1). Each base of the plurality of bases 325(1-*n*) includes a RF MEMS chip with a RF sensor (e.g., the first base 325(1) includes a first RF MEMS chip 335(1) with a first RF sensor 337(1)) adapted to sense a first RF signal 340(1) from a first RF MEMS chip 342(1) with a first RF transceiver 345(1) affixed to the first remote addressable device 305(1) such that when the first remote addressable device 305(1) is inserted or installed in the first base 325(1) the first RF MEMS chip 335(1) with the first RF sensor 337(1) on the first base 325(1) receives the first RF signal 340(1) from the first RF MEMS chip 342(1) with the first RF transceiver 345(1). The received first RF signal 340(1) is encoded with an address and a physical location of the first remote addressable device 305(1) such that the first RF MEMS chip 335(1) on the first base 325(1) learns configuration including the address and the physical location of a first new remote addressable device installed in the first base 325(1)**.

The device verification system 300 further comprises a second remote addressable device 305(2) that includes a second RF MEMS chip 342(2) with a second RF transceiver 345(2).

If the first remote addressable device 305(1) in the first base 325(1) is removed and the second remote addressable device 305(2) different from the first remote addressable device 305(1) is inserted into the first base 325(1) that was previously paired with the first remote addressable device 305(1) the second RF MEMS chip 342(2) on the second remote addressable device 305(2) recognizes that the first base 325(1) is already configured to another device and goes into a test/beacon mode 350 to signal to a mobile device 355 a trouble condition 360. The second remote addressable device 305(2) is configured to report the trouble condition 360 to a fire panel 365 with a message 367 that indicates an identity of the second remote addressable device 305(2) (i.e., its address and original base location) and that it is now installed in a wrong base.

A base of the plurality of bases **325(1-*n*) is pre-programmed based on a RF MEMS chip has an address and a physical location associated with an installed base. When a pre-programmed base of the plurality of bases 325(1-*n*)** with a RF MEMS chip receives a second new remote addressable device having a corresponding RF MEMS chip then the second new device is commissioned with a configuration/address from the RF MEMS chip of the pre-programmed base.

If a different remote addressable device is inserted into a base of the plurality of bases **325(1-*n*) having a RF MEMS chip that was previously paired with the first remote addressable device 305(1), then the different remote addressable device may have an override option where the different remote addressable device reports via a specific LED blinking or a user interface (UI) trouble report. A technician user interface input at the mobile device 355 could accept the override option or, after the different remote addressable device reports a trouble to the fire panel 365 with the message 367 that indicates identity of the second remote addressable device 305(2) (i.e., its address and original base location) and that it is now installed in a wrong base, the fire panel 365** selectively override the override option.

The first remote addressable device 305(1) of the plurality of remote addressable devices **305(1-*n*) includes the test/beacon mode 350 and a modulation circuit/module that comprises a modulation logic employed by a processor of the first remote addressable device 305(1) when commanded by the central controller 107 such as the fire panel 365 to enter the test/beacon mode 350. When in the test/beacon mode 350, the processor retrieves from a local memory its unique configuration data that is unique to the first remote addressable device 305(1) including its assigned address and its assigned location and encodes the unique configuration data in the first RF signal 340(1) of the first remote addressable device 305(1). Each remote addressable device of the plurality of remote addressable devices 305(1-*n*) has a near field transmitter/receiver (375(1), 375(2)**) with a logic.

Figure 4:
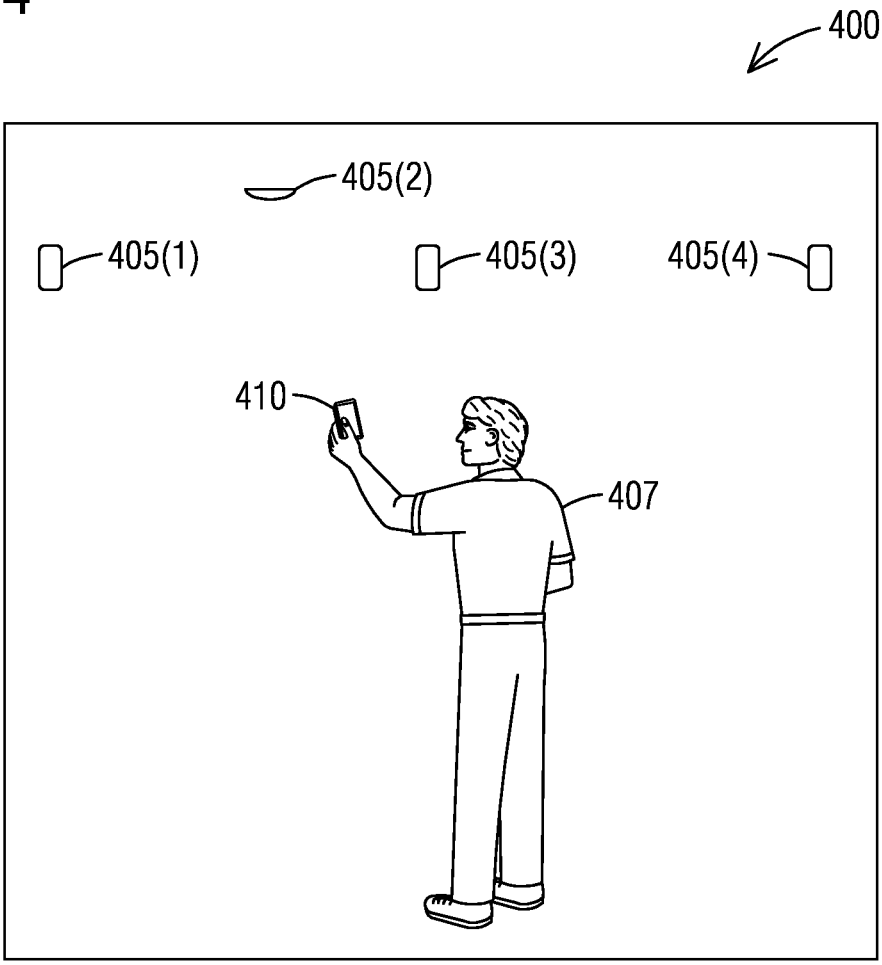
FIG. 4 illustrates an area with several remote addressable devices such that a technician uses a mobile device to detect signals from the remote addressable devices in accordance with an example embodiment of the present invention.

FIG. 4 illustrates an area 400 with several remote addressable devices 405(1-4) such that a technician 407 uses a mobile device 410 to detect signals from the remote addressable devices 405(1-4) in accordance with an example embodiment of the present invention. Inside of the area 400 there are several remote addressable devices 405(1-4) emitting signals. For example, each device 405 emits a coded message containing its address and other information as needed. Since the devices 405(1-4) are on a single control circuit associated with a fire panel, these data bursts are sequenced by a control circuit so as not to overlap. The mobile device 410 can selectively focus on a given device based on a direction in which the mobile device 410 is pointed in, with the ability to emit an optical or audible command to devices equipped to receive such signals. This response from an optical strobe device can contain its candela setting, from a horn its output settings, etc.

Figure 5:
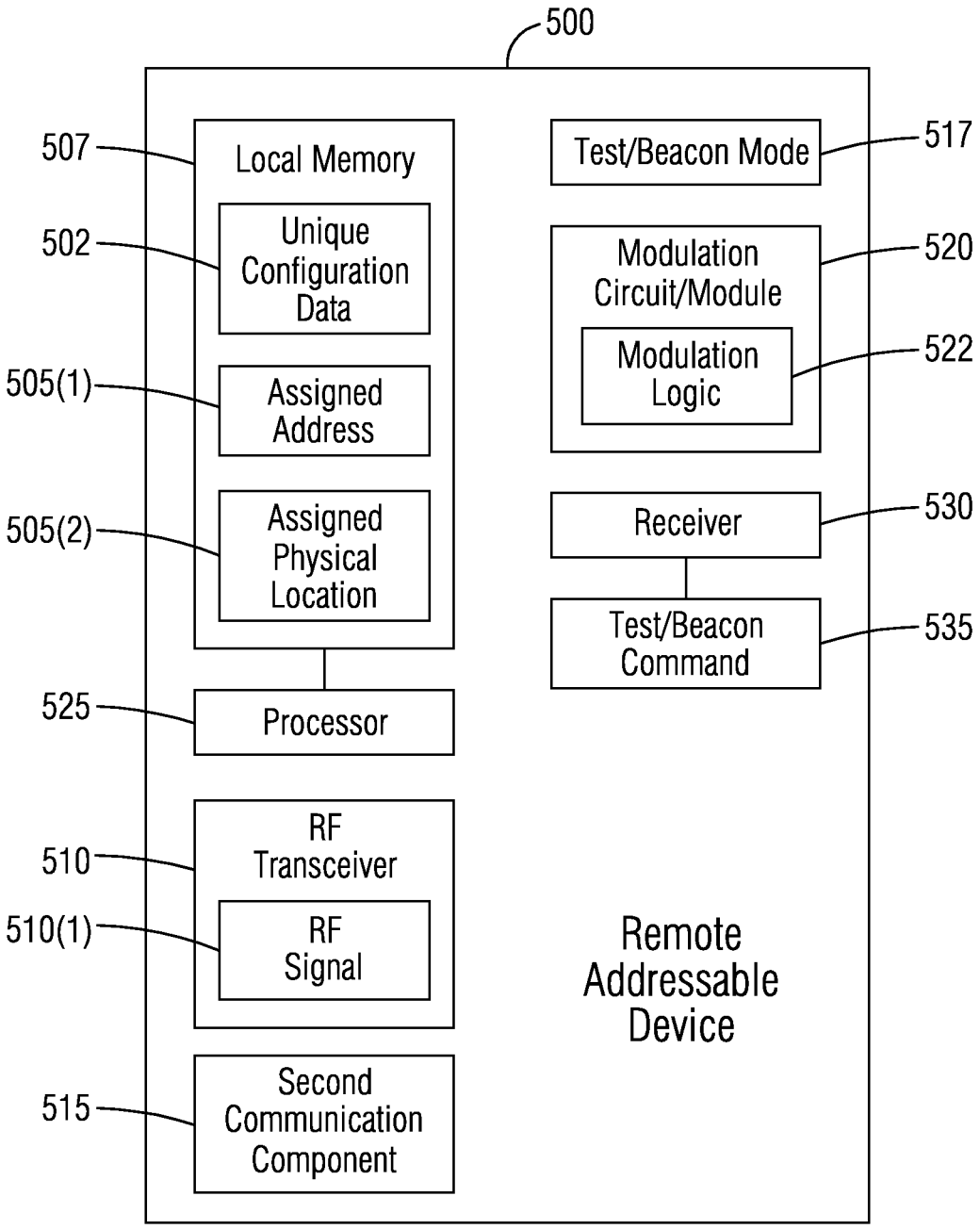
FIG. 5 illustrates a remote addressable device being individually programmed with unique configuration data including its assigned address and its assigned location in a local memory for emitting an output signal modulated to encode the unique configuration data and further includes a second communication component, a test/beacon mode, a modulation circuit/module that comprises a modulation logic employed by a processor, a receiver capable of detecting a test/beacon command in accordance with an example embodiment of the present invention.

As seen in FIG. 5, it illustrates a remote addressable device 500 being individually programmed with its unique configuration data 502 including its assigned address 505(1) and its assigned physical location 505(2) in a local memory 507. The remote addressable device 300 is configured to emit an RF signal 510(1) from an RF transceiver 510 modulated to encode the unique configuration data 502. The remote addressable device 500 further includes a second communication component 515, a test/beacon mode 517, a modulation circuit/module 520 that comprises a modulation logic 522 employed by a processor 525. The modulation logic 522 is employed by the processor 525 of the existing remote addressable device 500 when commanded by the central controller 107 to enter the test/beacon mode 517.

When in the test/beacon mode 517, the processor 525 retrieves from the local memory 507 its unique configuration data 502 that is unique to the existing remote addressable device 500 including its assigned address 505(1) and its assigned physical location 505(2) and encodes the unique configuration data 502 of the existing remote addressable device 500. The remote addressable device 500 further includes a receiver 530 capable of detecting a test/beacon command 535 in accordance with an example embodiment of the present invention.

Figure 6:
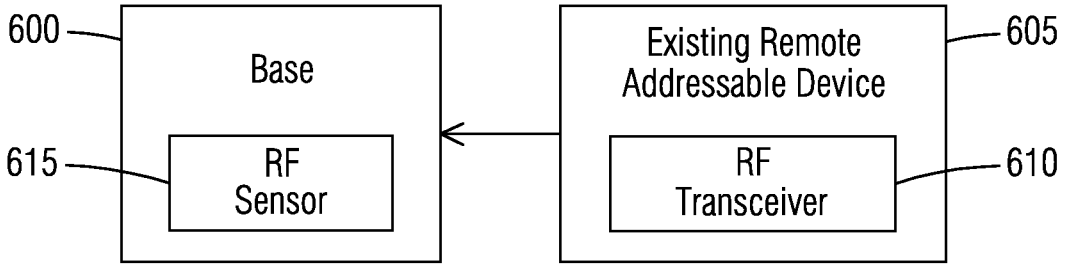
FIG. 6 illustrates a base in which an existing remote addressable device is installed in accordance with an example embodiment of the present invention.

As shown in FIG. 6, it illustrates a base 600 in which an existing remote addressable device 605 is installed and the existing remote addressable device 605 includes a RF transceiver 610. The base 600 includes a RF sensor 615 in accordance with an example embodiment of the present invention.

Figure 7:
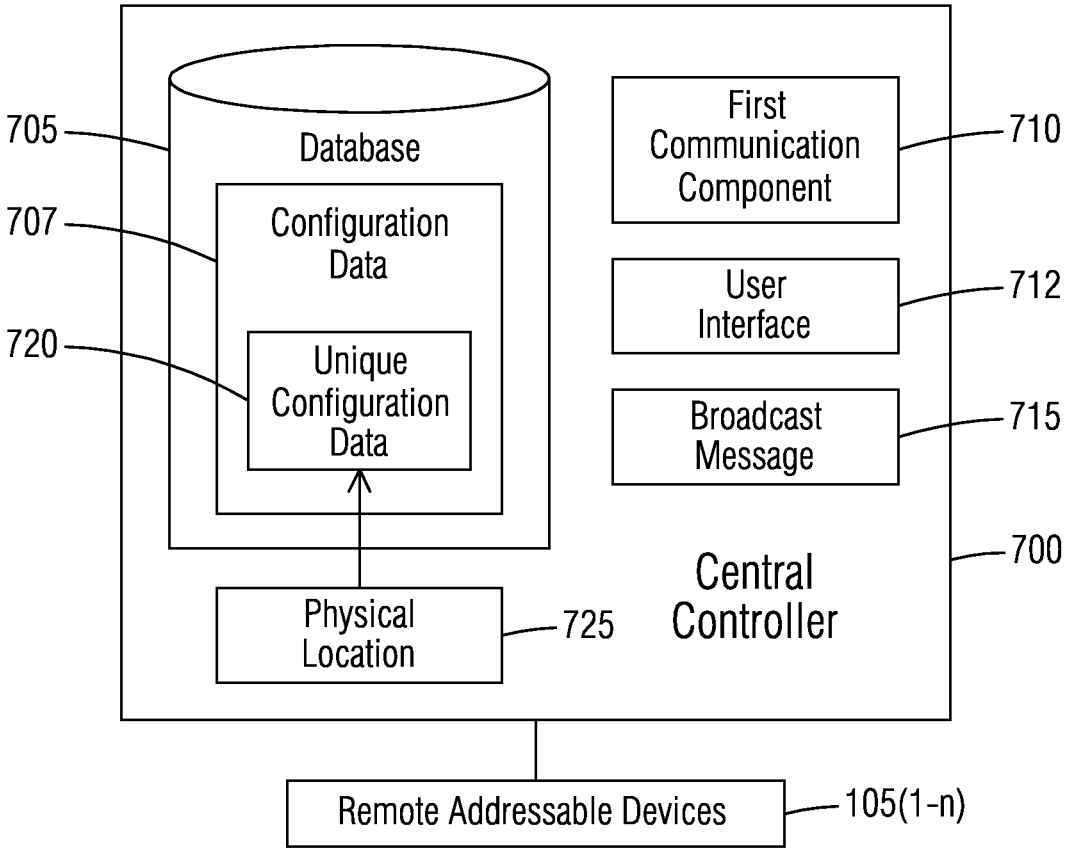
FIG. 7 illustrates a central controller having a database of respective configuration data and a first communication component such that the central controller is configured to send a broadcast message to all remote addressable devices in accordance with an example embodiment of the present invention.

In FIG. 7, it illustrates a central controller 700 having a database 705 of respective configuration data 707, a first communication component 710 and a user interface 712 such that the central controller 700 is configured to send a broadcast message 715 to all the remote addressable devices 105(1-*n*) in accordance with an example embodiment of the present invention. For example, the central controller 700 is configured to send the broadcast message 715 to all the remote addressable devices of the plurality of remote addressable devices 105(1-*n*) to go to a test/beacon mode to "blink"/"pulse out" or modulate unique data of a respective remote addressable device. Unique configuration data 720 of the respective addressable device 105 and a physical location 725 may be stored at the central controller 700.

For some embodiments, the database 705 of the central controller 700 may be pre-loaded into the mobile device 115, 410 so that this communication is not required when the technician is remote from the central controller 700. For example, the database 705 may be pre-loaded into a memory component of the mobile device 115, 410 either from the central controller 700 or from an external tool, such as a PC-based engineering tool.

Figure 8:
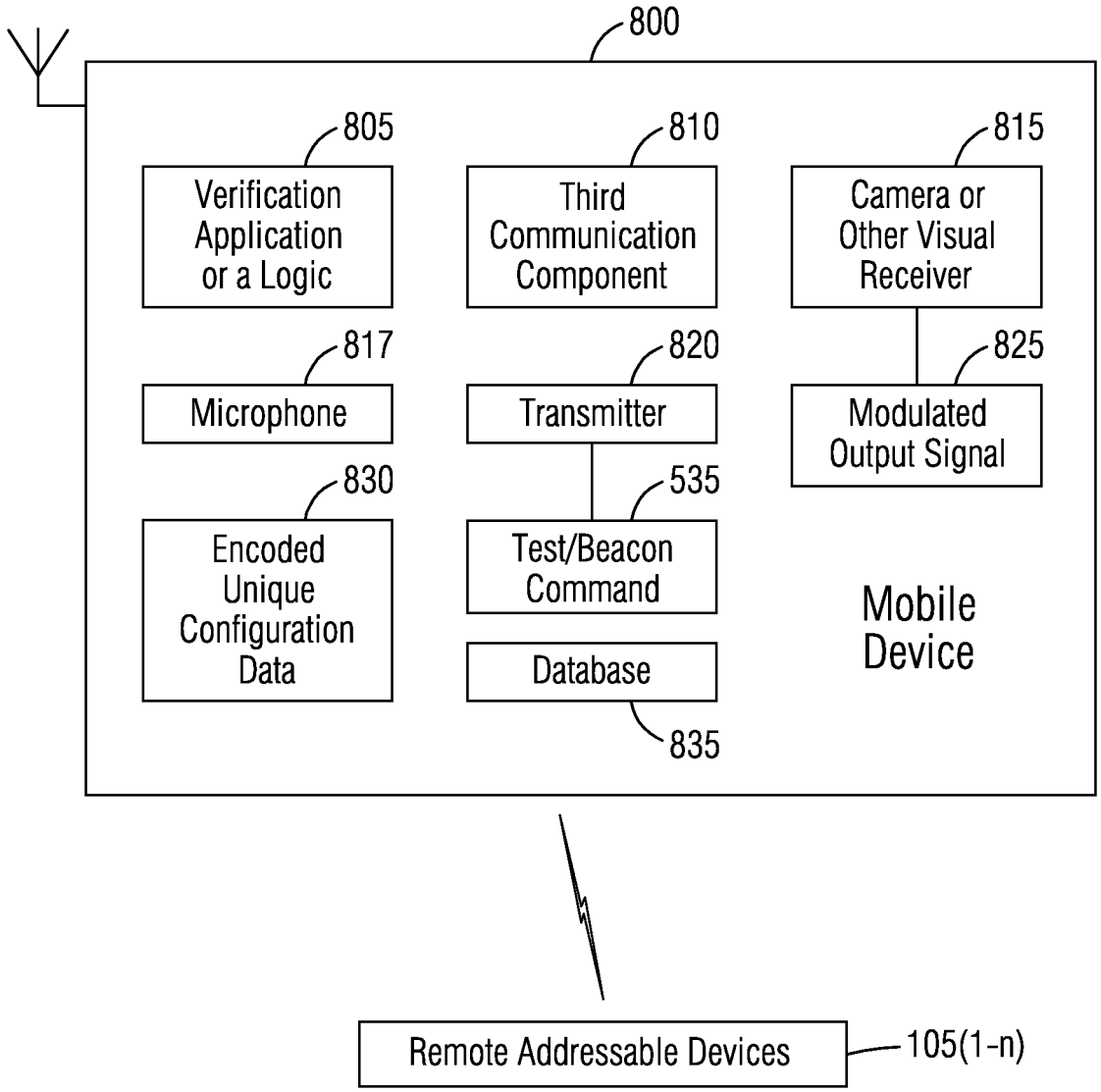
FIG. 8 illustrates a mobile device having a verification application or a logic, a third communication component, a camera or other visual receiver and a microphone such that the mobile device further including a transmitter capable of emitting a test/beacon command in accordance with an example embodiment of the present invention.

With regard to FIG. 8, it illustrates a mobile device 800 having a verification application 805 (e.g., software) or a logic, a third communication component 810, a camera or other visual receiver 815 and a microphone 817. The mobile device 800 further includes a transmitter 820 capable of emitting the test/beacon command 535 in accordance with an example embodiment of the present invention. The mobile device 800 includes the verification application 805 or a logic that is configured to use the mobile device's camera or other visual receiver 615 to receive a modulated output signal 825 from a remote addressable device of the plurality of remote addressable devices 105(1-*n*) and to de-modulate the modulated output signal to extract encoded unique configuration data 830 associated with the remote addressable device of the plurality of remote addressable devices 105(1-*n*).

The mobile device 800 having the third communication component 810 and the microphone 817 such that the mobile device 800 uses the verification application 815 or a logic to use the mobile device's microphone 817 to receive the modulated output signal 825 from a remote addressable device of the plurality of remote addressable devices 105 (1-*n*) and to de-modulate the modulated output signal 825 to extract the encoded unique configuration data 830 associated with the remote addressable device of the plurality of remote addressable devices 105(1-*n*).

The mobile device 800 can compare the extracted encoded unique configuration data 830 emitted by the remote addressable device 105 to a database 835 of respective configuration data for each remote addressable device of the plurality of remote addressable devices 105(1-*n*) for identifying and verifying the remote addressable device 105 based on a comparison between a detected address and a desired address and/or a detected location and a desired location such that configuration discrepancies or device defects are indicated on the mobile device 800.

As set forth in FIG. 5, the respective remote addressable device 500 includes the receiver 530 capable of detecting the test/beacon command 535. The receiver 530 may be one of an audio sensor or a light sensor. The mobile device 800 includes the transmitter 820 capable of emitting the test/beacon command 535 to cause the respective remote addressable device 500 to enter in the test/beacon mode 517. The transmitter 820 may be one of an audio source or a light source.

The mobile device 800 includes a device commissioning/location verification app such as the verification application 815 or the logic. During a commissioning process, a Bluetooth enabled or a RF beacon enabled first tracker module may be selectively activated as it is affixed to the base 600 for the remote addressable device of the plurality of remote addressable devices 105(1-*n*). Optionally a second tracker module is affixed to the remote addressable device of the plurality of remote addressable devices 105(1-*n*).

The mobile device 800 or the central controller 700 identifies the verification by (a) receiving the verification from the mobile device 800, (b) detecting the verification at the user interface 712 of the central controller 700, or (c) determining the verification based on the unique configuration data 720 of the respective addressable device 105 and the physical location 725 stored at the central controller 700.

Figure 9:
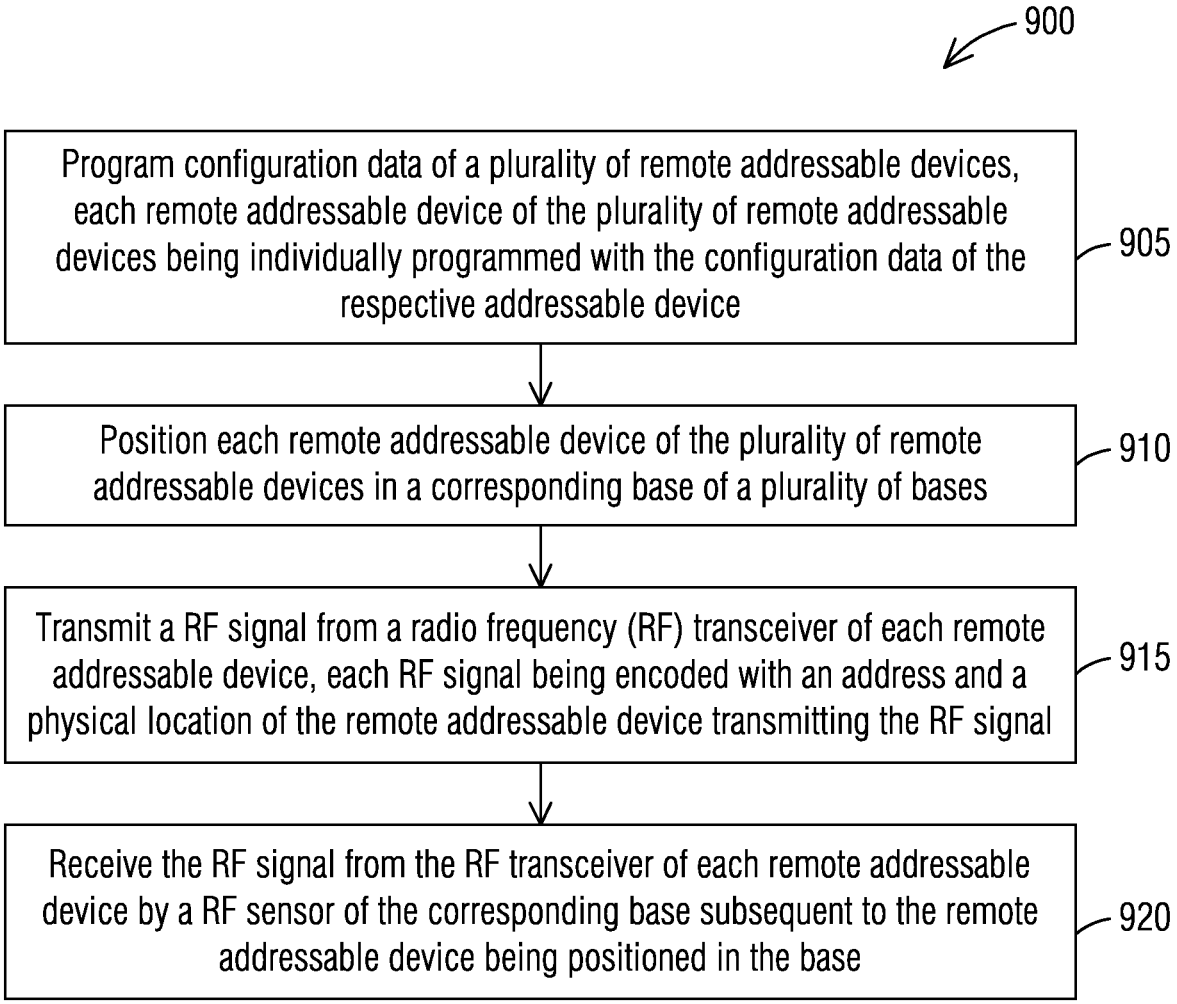
FIG. 9 illustrates a schematic view of a flow chart of a method of verifying an address and a physical location of a remote addressable device such as a fire safety device communicating with a central controller such as a fire panel in accordance with an example embodiment of the present invention.

With respect to FIG. 9, it illustrates a schematic view of a flow chart of a method 900 of verifying an address and a physical location of a remote addressable device such as a fire safety device communicating with a central controller such as a fire panel in accordance with an example embodiment of the present invention. Reference is made to the elements and features described in FIGS. 1-8. It should be appreciated that some steps are not required to be performed in any particular order, and that some steps are optional.

The method 700 comprises a step 905 of programming configuration data of a plurality of remote addressable devices, each remote addressable device of the plurality of remote addressable devices being individually programmed with the configuration data of the respective addressable device. The method 700 further comprises a step 910 of positioning each remote addressable device of the plurality of remote addressable devices in a corresponding base of a plurality of bases. The method 700 further comprises a step 915 of transmitting a RF signal from a radio frequency (RF) transceiver of each remote addressable device, each RF signal being encoded with an address and a physical location of the remote addressable device transmitting the RF signal. The method 700 further comprises a step 920 of receiving the RF signal from the RF transceiver of each remote addressable device by an RF sensor of the corresponding base subsequent to the remote addressable device being positioned in the base.

During normal operations, the device 105 polling LED blinks only when that device is uniquely receiving its address from the respective fire panel. This behavior can be augmented to have the light emitted by a polling LED encoded with the address and other information of the respective device. Under normal system supervision, the LED blink occurs at long intervals approximately equal to the number of devices on the circuit times 250 ms. On a fully utilized circuit of a fire panel, the LED would blink only once in approximately one minute. If the mobile device has the capability to focus on a single device, then a testing operation is initiated where the panel places the devices in a given circuit into a mode where the LED of each device in network communication with the circuit will emit its data on each data polling frame, every 250 ms. This latter technique improves efficiency but either method can be used for the purpose of gathering data.

The mobile device may receive and decode data from emitted LED light from devices that are modulated at pre-determined freq/encode key. With decoded data, the mobile device has program logic to: (1) determine device address from decoded data; (2) prompt user for current location; (3) check address and location look-up table to determine if address from device corresponds to associated pre=determined location. If not, the device flags all devices not associated with user identified location (e.g., in wrong room).

Remote Addressable devices 105(1-*n*) have a polling LED as a "Sign of Life" indicator. Typically, this LED performs a dim, quick flash that simply indicates that the device has heard from and spoken to the fire panel. If the current drive to this LED is increased, it can then be modulated by the device processor to encode data detectable by an external device but is not human observable. This data can be the physical device serial number, or the address assigned by the fire panel to this remote addressable device.

Figure 10:
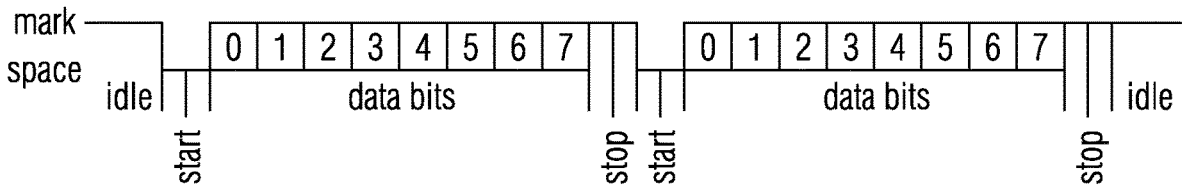
FIG. 10 illustrates modulation as a simple asynchronous data sequence in accordance with an example embodiment of the present invention.

The modulation can be a simple asynchronous data sequence as shown in FIG. 10; however, this type of modulation suffers from duty cycle issues. For example, during a series of all zeros the LED would only be on for one cell, the start bit. If the series were all ones, it would be on for eight cell periods giving an integrated illumination difference of 1 to 8, from barely visible to over bright. For this reason, this simple method is not desirable for the proposed technique.

Figure 11:
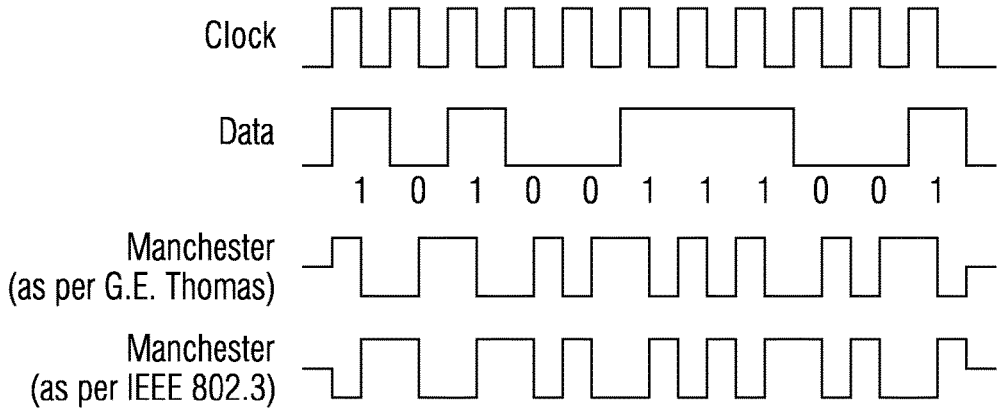
FIG. 11 illustrates Manchester encoding in accordance with an example embodiment of the present invention.

Manchester encoding is shown in FIG. 11. A Manchester encoded data stream or a more complex FM/FSK modulation on a high frequency carrier has a duty cycle that is very close to 50% at all times. While a slight flicker could be perceived it would not be as egregious as asynchronous signals. This, combined with a short duration in background identification mode, will allow the devices to constantly emit their address as a beacon via their respective polling LED.

Because the duration and brightness of the LED might become intrusive to occupants in the environment, this mode of operation may be optional in some embodiments. The mode is commanded from the fire panel to start at the being of an inspection session and continues until the end of the session.

Notification Appliances offer other signal sources such as horns, speakers, or LED strobe lights. The same forms of signal encoding, as previously discussed, can be used for these sources but power and control interfaces may limit the amount of data that can be transferred.

Two-way communication as used in at least one embodiment is described next in this paragraph. Notification Appliances, as envisioned, have microphones and photo diodes that are primarily used for self-test functions. These sensors, however, can also be used to receive signals from an external device, allowing commands to be received by the Notification Appliance (NA). The signal can originate from a mobile device such as a smartphone, dedicated device or a hybrid of the two.

ID on command as used in at least one embodiment is described next in this paragraph. If the device can receive a command, the identification Sequence rather than be continuous, can respond to a query from a mobile device. This will reduce the annoyance of a continuous audible sound or bright flash.

For audible communication the existing speaker within a smartphone may prove to be too weak, depending on the acoustics of the location. Also a standalone smartphone may not be able to focus on a single device.

While radio frequency (RF) communications are described here a range of one or more other types of communications are also contemplated by the present invention. For example, other forms of communications may be implemented based on one or more features presented above without deviating from the spirit of the present invention.

The techniques described herein can be particularly useful for fire safety systems installed in a building system. While particular embodiments are described in terms of the fire safety systems, the techniques described herein are not limited to such systems but can also be used with other device verification systems.

While embodiments of the present invention have been disclosed in example forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A system comprising:

a plurality of remote addressable fire devices, each remote addressable fire device of the plurality of remote addressable fire devices being individually programmed with configuration data of the respective addressable fire device, each remote addressable fire device including a radio frequency (RF) transceiver to transmit a RF signal encoded with an address and a physical location of the remote addressable fire device transmitting the RF signal; and a plurality of bases, each base of the plurality of bases including a RF sensor receiving the RF signal from the RF transceiver of the corresponding remote addressable fire device subsequent to the remote addressable fire device being positioned in the base.

2. The system of claim 1, wherein the received RF signal is encoded with the address and the physical location of the remote addressable fire device such that a first RF MEMS chip on a first base of the plurality of bases learns configuration including the address and the physical location of a first new remote addressable fire device installed in the first base.

3. The system of claim 1, further comprising:

a second remote addressable fire device including a second RF MEMS chip with a second RF transceiver, wherein the remote addressable fire device includes a first RF MEMS chip with the RF transceiver, wherein if the remote addressable fire device in the first base is removed and the second remote addressable fire device different from the remote addressable fire device is inserted into the first base that was previously paired with the remote addressable fire device the second RF MEMS chip on the second remote addressable fire device recognizes that the first base is already configured to another device and goes into a test/beacon mode to signal to a mobile device a trouble condition.

4. The system of claim 3, wherein the second remote addressable fire device is configured to report the trouble condition to a fire panel with a message that indicates an identity of the second remote addressable fire device (i.e., its address and original base location) and that it is now installed in a wrong base.

5. The system of claim 3, wherein a base of the plurality of bases is pre-programmed based on a RF MEMS chip has an address and a physical location associated with an installed base.

6. A method comprising:

programming configuration data of a plurality of remote addressable fire devices, each remote addressable fire device of the plurality of remote addressable fire devices being individually programmed with the configuration data of the respective addressable device;

positioning each remote addressable fire device of the plurality of remote addressable fire devices in a corresponding base of a plurality of bases;

transmitting a RF signal from a radio frequency (RF) transceiver of each remote addressable fire device, each RF signal being encoded with an address and a physical location of the remote addressable fire device transmitting the RF signal; and receiving the RF signal from the RF transceiver of each remote addressable fire device by an RF sensor of the corresponding base subsequent to the remote addressable fire device being positioned in the base.

7. The method of claim 6, wherein the received RF signal is encoded with the address and the physical location of the remote addressable fire device such that a first RF MEMS chip on a first base of the plurality of bases learns the configuration data including the address and the physical location of a first new remote addressable fire device installed in the first base.

8. The method of claim 7, further comprising:

providing the remote addressable fire device including a first RF MEMS chip with the RF transceiver, providing a second remote addressable fire device including a second RF MEMS chip with a second RF transceiver, and wherein if the remote addressable fire device in a first base of the plurality of bases is removed and the second remote addressable fire device different from the remote addressable fire device is inserted into the first base that was previously paired with the remote addressable fire device the second RF MEMS chip on the second remote addressable fire device recognizes that the first base is already configured to another device and goes into a test/beacon mode to signal to a mobile device a trouble condition.

9. The method of claim 8, wherein the second remote addressable fire device is configured to report the trouble condition to a fire panel with a message that indicates an identity of the second remote addressable fire device (i.e., its address and original base location) and that it is now installed in a wrong base.

10. The method of claim 8, wherein a base of the plurality of bases is pre-programmed based on a RF MEMS chip has an address and a physical location associated with an installed base.

11. A system comprising:

a plurality of remote addressable fire devices including a first remote addressable fire device, each remote addressable fire device of the plurality of remote addressable fire devices being individually programmed with configuration data of a respective addressable fire device of the plurality of remote addressable fire devices, wherein each remote addressable fire device includes a radio frequency (RF) micro-electromechanical systems (MEMS) chip with a RF transceiver to produce a RF signal; and a plurality of bases including a first base, each base of the plurality of bases includes a RF MEMS chip with a RF sensor adapted to sense a first RF signal from a first RF MEMS chip with a first RF transceiver affixed to the first remote addressable fire device such that when the first remote addressable fire device is inserted or installed in the first base a first RF MEMS chip with a first RF sensor on the first base receives the first RF signal from the first RF MEMS chip with the first RF transceiver, wherein the received first RF signal is encoded with an address and a physical location of the first remote addressable fire device such that the first RF MEMS chip on the first base learns configuration including the address and the physical location of a first new remote addressable device installed in the first base.

12. The system of claim 11, further comprising:

a second remote addressable fire device including a second RF MEMS chip with a second RF transceiver, wherein if the first remote addressable fire device in the first base is removed and the second remote addressable fire device different from the first remote addressable fire device is inserted into the first base that was previously paired with the first remote addressable fire device the second RF MEMS chip on the second remote addressable fire device recognizes that the first base is already configured to another device and goes into a test/beacon mode to signal to a mobile device a trouble condition.

13. The system of claim 12, wherein the second remote addressable fire device is configured to report the trouble condition to a fire panel with a message that indicates an identity of the second remote addressable fire device (i.e., its address and original base location) and that it is now installed in a wrong base.

14. The system of claim 12, wherein a base of the plurality of bases is pre-programmed based on a RF MEMS chip has an address and a physical location associated with an installed base.

15. The system of claim 12, wherein when a pre-programmed base of the plurality of bases with a RF MEMS chip receives a second new remote addressable fire device having a corresponding RF MEMS chip then the second new device is commissioned with a configuration/address from the RF MEMS chip of the pre-programmed base.

16. The system of claim 12, wherein if a different remote addressable fire device is inserted into a base of the plurality of bases having a RF MEMS chip that was previously paired with the first remote addressable fire device, then the different remote addressable device may have an override option where the different remote addressable fire device reports via a specific LED blinking or a user interface (UI) trouble report.

17. The system of claim 15, wherein a technician user interface input at the mobile device could accept the override option or, after the different remote addressable fire device reports a trouble to a fire panel with a message that indicates identity of the second remote addressable fire device (i.e., its address and original base location) and that it is now installed in a wrong base, the fire panel selectively override the override option.

18. The system of claim 12, wherein the first remote addressable fire device of the plurality of remote addressable fire devices includes the test/beacon mode and a modulation circuit/module that comprises a modulation logic employed by a processor of the first remote addressable fire device when commanded by a central controller to enter the test/beacon mode.

19. The system of claim 18, wherein when in the test/beacon mode, the processor retrieves from a local memory its unique configuration data that is unique to the first remote addressable fire device including its assigned address and its assigned location and encodes the unique configuration data in the first RF signal of the first remote addressable fire device.

20. The system of claim 11, wherein each remote addressable fire device of the plurality of remote addressable fire devices has a near field transmitter/receiver with a logic.

* * * * *